United States Patent [19]

Servi

[11] Patent Number: 4,643,479

[45] Date of Patent: Feb. 17, 1987

[54] WHEELCHAIR SHADE OR CANOPY MEANS

[76] Inventor: John K. Servi, 12869 Norris Ave., Sylmar, Calif. 91342

[21] Appl. No.: 759,481

[22] Filed: Jul. 26, 1985

[51] Int. Cl.[4] ..... A47C 7/66

[52] U.S. Cl. ..... 297/184; 297/440

[58] Field of Search ..... 297/184, DIG. 4, DIG. 2, 297/397, 391, 191, 440

[56] References Cited

U.S. PATENT DOCUMENTS

| | | | |
|---|---|---|---|
| 1,271,515 | 7/1918 | Murray | 297/184 |
| 2,511,452 | 6/1950 | Anderson et al. | 297/184 |
| 2,752,929 | 7/1956 | Berger | 297/184 |
| 3,243,230 | 3/1966 | Otto | 297/184 |
| 3,476,404 | 11/1969 | Rachman | 297/DIG. 4 |
| 3,497,259 | 2/1970 | Sherfey | 297/391 |
| 3,840,161 | 10/1974 | Boggs et al. | 297/184 |
| 4,201,416 | 5/1980 | Vanderminden | 297/184 |
| 4,389,057 | 6/1983 | Richard | 297/184 |

*Primary Examiner*—Francis K. Zugel

*Attorney, Agent, or Firm*—Erik M. Arnhem

[57] ABSTRACT

The sun shade for the occupant of a wheelchair is comprised of a frame structure which can be mounted at the handle grips of a wheelchair. The frame structure includes at least two vertically disposed posts, at least one transverse member for bracing the two vertically disposed posts, and roof-forming members connected to the upwardly extending ends of the two vertically disposed posts. The shade is provided by a sheet of vinyl, canvas or the like and the sheet can be secured by way of snap-on buttons or similar releasable fasteners. The range of the sun shade can be increased by a forward visor portion. The roof portion can be folded to the rear of the wheelchair by being pivotally mounted to the vertically disposed posts.

5 Claims, 8 Drawing Figures

FIG. 5
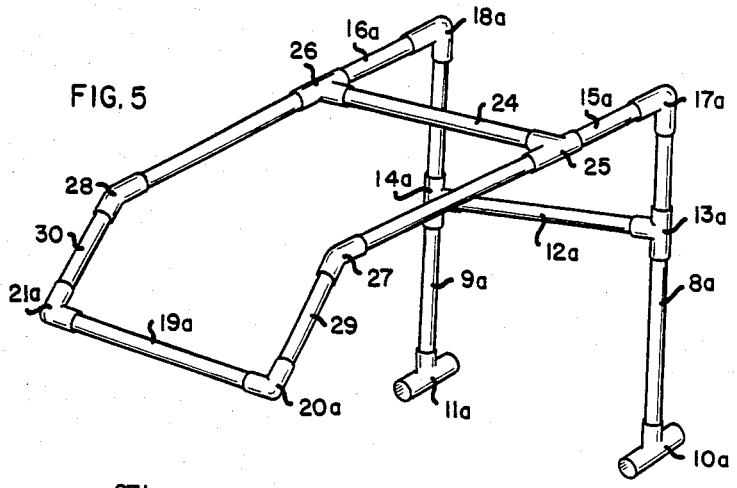
FIG.6
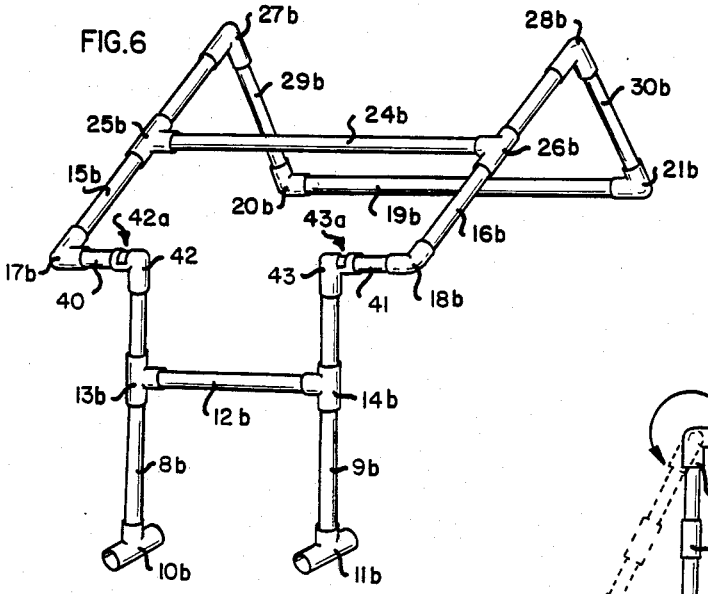
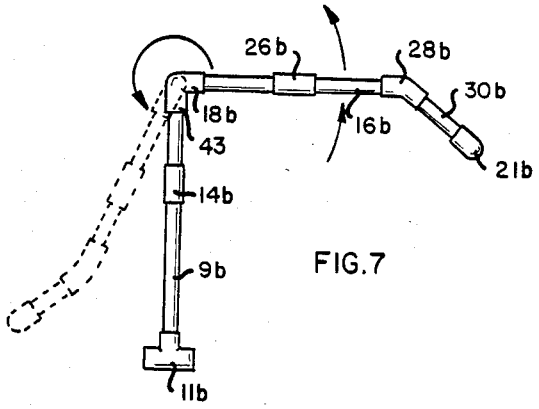
FIG.7
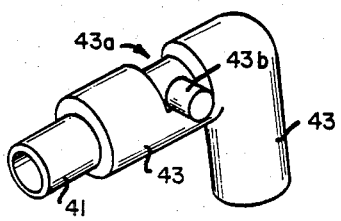
FIG.8

WHEELCHAIR SHADE OR CANOPY MEANS

BACKGROUND OF THE INVENTION (1) Field of the Invention

The invention may be classified in class 297 and appropriate sub-classes.

My present invention relates generally to wheelchair shade means and, more particularly, to an improved shade or canopy which can be attached to the handlebars of a wheelchair.

(2) Prior Art

The prior art includes U.S. Pat. Nos. 215,601; 309,451; 900,572; 1,271,515; 4,201,416; and 4,389,057.

The mobility of a disabled person is greatly increased through a wheelchair, powered manually or by other means, e.g. electricity. When moving about outdoors, however, the need arises to provide a shade against the sun for the chair and its occupant.

Thus, there has remained the need for an improved shade or canopy unit which can be quickly attached to a wheelchair, particularly the handlebars thereof, for protecting the occupant of the wheelchair against sunlight.

SUMMARY OF THE INVENTION

My invention is directed towards the provision of a sun shade means or similar canopy which can be quickly attached to or mounted on the handles or grip ends of the wheelchair with which it is to be used. The shade means includes a lightweight and durable frame structure and includes a cover such as a canvas or vinyl sheet, or similar sheeting secured at the frame structure. The shade means is generally assembled from standard components, including tees, elbows, standard pieces of PVC pipe, canvas sheeting and snap-on buttons.

The device is designed to provide adequate protection against the effects of sunlight.

Included in the objects of my invention are:

To provide an improved wheelchair shade or canopy means which is of simple construction.

To provide a wheelchair shade or canopy means which can be easily and effectively mounted on and removed from the handlebars of the wheelchair on which it is being used.

BRIEF DESCRIPTION OF THE DRAWINGS

The above and other objects, features and advantages will become apparent from the following description, reference being made to the accompanying drawing in which:

FIG. 5 is a perspective view showing a further embodiment of a shade having a forwardly directed visor extension.

FIG. 6 is a perspective view of another embodiment of a shade having a tiltable roof portion.

FIG. 7 is a side elevation of the frame according to FIG. 6 indicating the tilting of the roof portion.

FIG. 8 is a perspective view showing details of the pivot means for folding the shade to the back.

SPECIFIC DESCRIPTION

Figure 1:
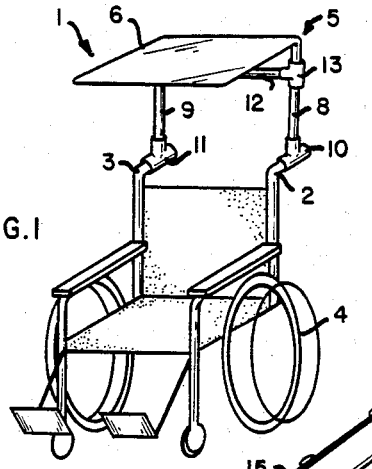
FIG. 1 is a perspective view of a wheelchair with a shade mounted on the handlebars thereof, in accordance with one embodiment of my invention.
Figure 2:
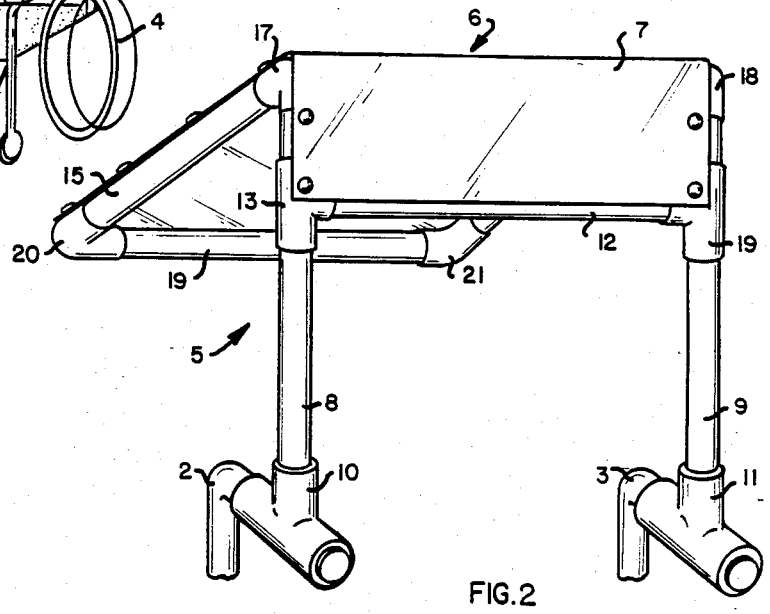
FIG. 2 is a perspective view from the rear of the shade.
Figure 3:
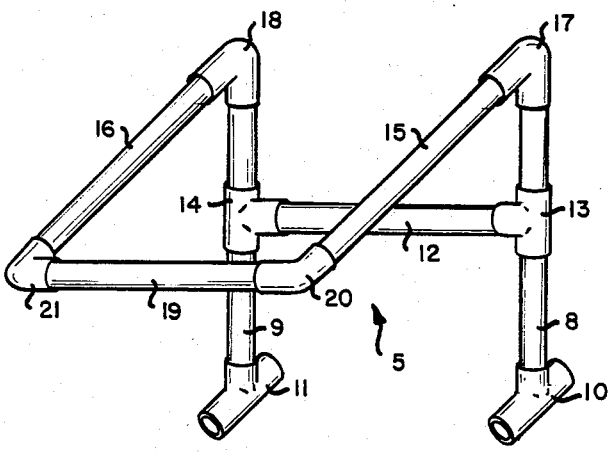
FIG. 3 is a perspective view from the front of the frame structure.

In the drawing like reference characters designate like elements in the various views of the drawings.

As indicated in FIG. 1, the shade or canopy 1 is mounted on the handle bars or grips 2 and 3 of a wheelchair 4. This shade 1 includes a frame structure 5 over which extends a cover 6, say a vinyl or canvas cover 7, or the like sheet, or webbing.

More specifically, for provision of the back of the shade, the frame structure 5 includes two vertically disposed tubular members or posts 8 and 9. The lower ends of the posts 8 and 9 are respectively connected to the handle bars 2 and 3 of the wheelchair by way of t-pieces 10 and 11, it being understood that other connectors may be used, say elbow or similar 90° elements.

A horizontal transverse brace element 12 of tubular configuration is connected to the posts 8 and 9 near the mid-height thereof, and this brace element 12 is also connected by means of t-pieces 13 and 14 to the posts 8 and 9.

The roof portion of the shade is formed by two horizontally disposed tubular members 15 and 16 which are respectively connected to the upper ends of the post 8 and 9 by way of elbows 17 and 18. An end member 19 is connected at the forward ends of the forwardly directed members 15 and 16, also by elbows 20 and 21.

Figure 4:
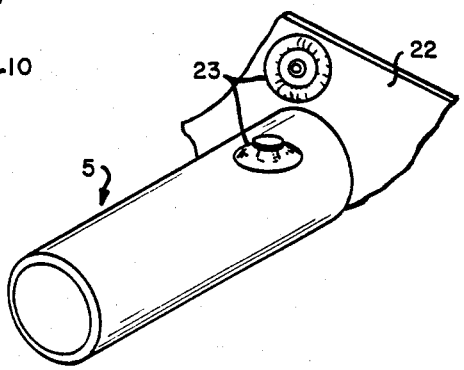
FIG. 4 is a perspective view showing the typical securement of the cover to the frame.

The cover 6 is typically secured to the frame structure 5 as is indicated in FIG. 4. Thus, the end portion 22 of a strap, sheet or the like is passed around the respective component of the frame 5, and it is then secured by one or several snap-on button 23. Accordingly, the cover 6 is releasably connected to the frame 5. The cover 6 may also be permanently secured, for example by rivets.

With reference to FIG. 5, this embodiment also includes two vertically disposed tubular members or posts 8*a* and 9*a*. The lower ends of the posts 8*a* and 9*a* can be connected to the handle bars 2 and 3 (FIG. 1) of the wheelchair by way of t-pieces 10*a* and 11*a*. A horizontal transverse brace element 12*a* of tubular configuration is connected to the posts 8*a* and 9*a* near the mid-height thereof, and this brace element 12*a* is also connected by means of t-pieces 13*a* and 14*a* to the posts 8*a* and 9*a*.

The roof portion of this shade is formed by two horizontally disposed tubular members 15*a* and 16*a* which are respectively connected to the upper ends of the post 8*a* and 9*a* by way of elbows 17*a* and 18*a*. An intermediate member 24 which is adapted to serve as a cross brace, is connected at approximately the mid-point of the forwardly directed members 15*a* and 16*a* by means of t-pieces 25 and 26. Bent connectors 27 and 28, for example 45° elbows, are connected at the forward ends of the members 15*a* and 16*a*. These connectors 27 and 28 serve to incline the visor portion of the shade which is formed by the short visor pieces 29 and 30 and end member 19*a* connected to the forward ends of the downwardly directed tubular pieces 29 and 30, also by elbows 20*a* and 21*a*.

With reference to FIG. 6, this embodiment of the shade comprises a folding roof portion. This embodiment includes two vertically disposed tubular members or posts 8*b* and 9*b*. The lower ends of the posts 8*b* and 9*b* can be connected to the handle bars 2 and 3 (FIG. 1) of the wheelchair by way of t-pieces 10*b* and 11*b*. A horizontal transverse brace element 12*b* of tubular configuration is connected to the posts 8b and 9b near the mid-height thereof, and this brace element 12b is also connected by means of t-pieces 13b and 14b to the posts 8b and 9b.

The roof portion of this shade includes two short intermediate tubular members 40 and 41 which are respectively connected to the upper ends of the post 8b and 9b by way of elbows 42 and 43. To serve as an adjustable support brace, an intermediate member 24b is connected at approximately the mid-point of the forwardly directed members 15b and 16b, by means of the t-pieces 25b and 26b. Again, two bent connectors 27b and 28b, for example 45° elbows, are connected at the forward ends of the members 15b and 16b. These two connectors 27b and 28b serve to incline the visor portion of the shade which is formed by the pieces 29b and 30b, as well as end member 19b, connected to the forward ends of the downwardly directed members 29b and 30b, also by elbows 20b and 21b.

The respective ends of the intermediate members 40 and 41 are pivotally or hingedly secured to the elbows 42 and 43 which, in turn, are secured to the posts 8b and 9b, respectively. Thus, the shade can be selectively brought into the operative position as is indicated in solid outline in the side elevation of FIG. 7 and can be folded or swung back to assume the position indicated in dash lines in FIG. 7. The respective movement is controlled by means of slots 42a and 43a (FIG. 6) in the elbows 42 and 43, through each of which respectively emerges a guide pin (only one is shown at 43b in FIG. 8). These guide pins respectively serve to limit the movement of the roof portion of the shade 1.

While my invention has been described and illustrated with respect to a preferred embodiment, it is not intended to restrict the scope of the appended claims, which themselves recite those features regarded as essential to the invention.

I claim:

1. A shade means especially for protecting occupants in wheelchairs, comprising in combination:

a frame structure adapted to be connected to the handlebars of the respective wheelchair, said frame structure including at least two vertically disposed posts; with the lowermost ends of said at least two vertically disposed posts being adapted to be connected at the handlebars of the respective wheelchair; at least two roof-forming members connected with their rearward ends to the upwardly extending ends of said at least two vertically disposed posts, said roof-forming members being hingedly secured to the said at least two vertically disposed posts; and at least one end member connected with its respective ends to the forwardly directed ends of said at least two roof-forming members;

for each roof-forming member, at least one intermediate member, and at least one first elbow for connecting a respective roof-forming member to its respective intermediate member and for each intermediate member at least one second elbow for connecting it to the respective one of said at least two vertically disposed posts, with each second elbow allowing pivotal movement of its respective intermediate member; and a cover means for shielding the occupant of the wheelchair, said cover means extending substantially over the area defined between said at least two roof-forming members and a predetermined distance between said at least two vertically disposed posts.

2. The sun shade according to claim 1 wherein said frame structure is made of tubular pipe of polyvinylchloride and the like lightweight material.

3. The sun shade according to claim 1 wherein said cover means secured to said frame structure is a canvas sheet.

4. The sun shade according to claim 1 wherein said frame structure includes an inclined visor comprised of at least two visor members, and at least two elbows for respectively connecting each one of said at least two visor members with its rearward end to the end of a respective one of said at least two roof-forming members.

5. The sun shade according to claim 1 wherein said frame structure includes at least one transverse member for bracing said at least two roof-forming members, and respective t-pieces for adjustably securing said at least one transverse member near the mid-distance of said at least two roof-forming members.

* * * * *